US008460079B2

(12) United States Patent
Smith

(10) Patent No.: US 8,460,079 B2
(45) Date of Patent: Jun. 11, 2013

(54) PARI-MUTUEL WAGERING APPARATUS AND METHOD

(76) Inventor: Ernie Smith, Calabasas, CA (US)

( * ) Notice: Subject to any disclaimer, the term of this patent is extended or adjusted under 35 U.S.C. 154(b) by 0 days.

(21) Appl. No.: 13/424,274

(22) Filed: Mar. 19, 2012

(65) Prior Publication Data

US 2012/0302322 A1 Nov. 29, 2012

Related U.S. Application Data

(63) Continuation-in-part of application No. 11/817,161, filed as application No. PCT/US2006/007089 on Feb. 27, 2006, now Pat. No. 8,137,175.

(60) Provisional application No. 60/656,214, filed on Feb. 25, 2005.

(51) Int. Cl.
*A63F 9/24* (2006.01)

(52) U.S. Cl.
USPC ..... 463/16; 463/12; 463/17; 463/20; 463/42; 700/90; 700/91; 700/92; 700/93

(58) Field of Classification Search
USPC ..... 463/12, 16, 17, 20, 42; 700/90, 91, 700/92, 93
See application file for complete search history.

(56) References Cited

U.S. PATENT DOCUMENTS

| | | | | |
|---|---|---|---|---|
| 6,152,822 | A * | 11/2000 | Herbert | 463/22 |
| 6,631,473 | B2 * | 10/2003 | Townsend | 726/25 |
| 7,080,041 | B2 * | 7/2006 | Nagel | 705/51 |
| 7,152,047 | B1 * | 12/2006 | Nagel | 705/76 |
| 2002/0010022 | A1 * | 1/2002 | Vincent | 463/42 |
| 2002/0068521 | A1 * | 6/2002 | Tanaka et al. | 454/156 |
| 2002/0077712 | A1 * | 6/2002 | Safaei et al. | 700/93 |
| 2004/0198483 | A1 * | 10/2004 | Amaitis et al. | 463/16 |
| 2005/0148379 | A1 * | 7/2005 | Huard et al. | 463/16 |
| 2006/0084500 | A1 * | 4/2006 | Baerlocher et al. | 463/25 |
| 2007/0072668 | A1 * | 3/2007 | Hein et al. | 463/16 |
| 2008/0248850 | A1 * | 10/2008 | Schugar | 463/16 |

* cited by examiner

*Primary Examiner* — Pierre Eddy Elisca
*Assistant Examiner* — Shahid Kamal
(74) *Attorney, Agent, or Firm* — Cascio & Zervas; Anthony T. Cascio; Charles H. Jew

(57) ABSTRACT

A handheld device in communication with a tote board of at a pari-mutuel wagering event receives data concerning the competitive entries and the odds associated with each entry. For each event, a total bet is determined and a subset of entries picked for which the total bet is to be allocated among. A computation is made as to the allocation based on the current odds of each entry and the desired rate of return on the total bet if any of the selected entries wins. The bet and entry data is then uploaded to the tote board at which it is accepted and entered.

16 Claims, 2 Drawing Sheets

PARI-MUTUEL WAGERING APPARATUS AND METHOD

RELATED APPLICATION DATA

The present application is a continuation-in-part of entitled to the benefit of and claims priority from the commonly owned, United States application for patent having at least one inventor in common herewith entitled "Pari-mutuel Wagering System," application Ser. No. 11/817,161, filed Aug. 27, 2007, now U.S. Pat. No. 8,137,175, issued Mar. 20, 2012, which is a national stage application under 35 U.S.C. §371 of Patent Cooperation Treaty Application No. PCT/US2006/007089, filed Feb. 27, 2006, which is a non-provisional of United States Application for Provisional Patent, Application No. 60/656,214, filed Feb. 25, 2005, the specification of which is incorporated herein by reference.

BACKGROUND OF THE INVENTION

In many games in which contestants compete against each other, a player observes an initial state of the game and, based upon the rules of the game and possible other subjective and objective criteria, makes a determination as to what the player believes will be, at least in part, the final state of the game which will indicate a winner or a finishing order of its contestants. For example, the player first analyzes various subjective and objective criteria in a race among various competing entries; selects what the player believes will be the overall winner or the final order of some or all of the entries.

In particular, in horse racing a bettor may place bets on one or more horses in any race wherein each horse has betting odds associated therewith. The odds determine the amount of money to be returned to the bettor per unit amount bet should such horse win the race. Typically, the bettor refers to a racing sheet to obtain subjective and objective information about each horse in the race to assist in the selection of bets. Selection of bets in any one race may include bets on each of long and short odds to minimize risk and maximize gain.

In the prior co-pending application referenced above, there are disclosed algorithms which the bettor may utilize to allocate, within a maximum bet total, such portions of that total among several entries in a single race so that is any one of the entries win a predetermined rate of return will be realized. Reference is made therein that the algorithms may be embedded in a calculating device. The present disclosure is directed to a specific implementation of such a device which may be used by a bettor.

SUMMARY OF THE INVENTION

The present invention is directed to a pari-mutuel wagering method and apparatus that enables a bettor to determine specific amounts to bet on each of several entries in a race in accordance with specific predetermined criteria, such as total amount to be bet and consistency of profit should any of the selected entries win. In accordance with the present invention, a handheld device in communication with a tote board of at a pari-mutuel wagering event receives data concerning the competitive entries and the odds associated with each entry. For each event, a total bet is determined and a subset of entries picked for which the total bet is to be allocated among. A computation is made as to the allocation based on the current odds of each entry and the desired rate of return on the total bet if any of the selected entries wins. The bet and entry data is then uploaded to the tote board at which it is accepted and entered.

Further advantages and features of the present wagering method include the capability of adding and/or subtracting or otherwise changing the identities of the entries to be bet upon, and/or the odds of each entry winning to arrive at the desired profit margin. Additionally, the present wagering method is adapted to indicate that particular bet or set of bets should not be made if a predetermined minimum profit cannot be realized with the prospective bet or set of bets.

These and other objects, advantages and features of the present invention will become readily apparent to those skilled in the art from a study of the following Description of the Exemplary Preferred Embodiments when read in conjunction with the attached Drawing and appended Claims.

DESCRIPTION OF THE EXEMPLARY PREFERRED EMBODIMENTS

Figure 1:
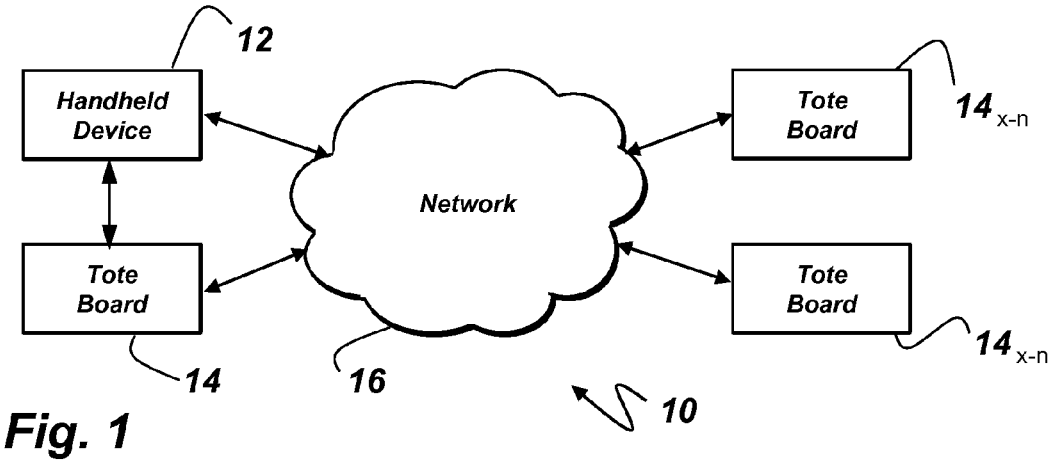
FIG. 1 is a schematic block diagram of a network system incorporating a handheld device constructed according to the principles of the present invention.

Referring now to FIG. 1, there is shown an exemplary system 10 in which a handheld user device 12, which is constructed according to the herein after described principles of the present invention, may communicate with a tote board 14. The handheld device 12 may preferably be a dedicated device designed for portability and use anywhere capability, but as described below a dedicated user device, such as handheld device 12, is not necessary to practice the methods of present invention.

Exemplarily, the communication between the handheld device 12 and the tote board 14 may be established over any known wireless protocol. When the handheld device 12 is in direct communication with the tote board 14, the exemplary scenario is that the user of the handheld device is present at an establishment, such as a track or off-site betting location, at which the tote board is located.

It is also contemplated that the handheld device 12 may be used remotely from any such establishment and be in communication, not only with the tote board 14, but also with one or more additional tote boards $\mathbf{14}_{x\text{-}n}$. In this scenario, the handheld device 12 and the additional tote boards $\mathbf{14}_{x\text{-}n}$ are in network communication over a network 16, exemplarily the internet. Furthermore, the handheld device may also be in either wireless or network communication with the tote board 14 simultaneously with the additional tote boards $\mathbf{14}_{x\text{-}n}$. The description herein below as it relates to the tote board 14 is assumed to also apply equally to the additional tote boards $\mathbf{14}_{x\text{-}n}$.

Figure 2:
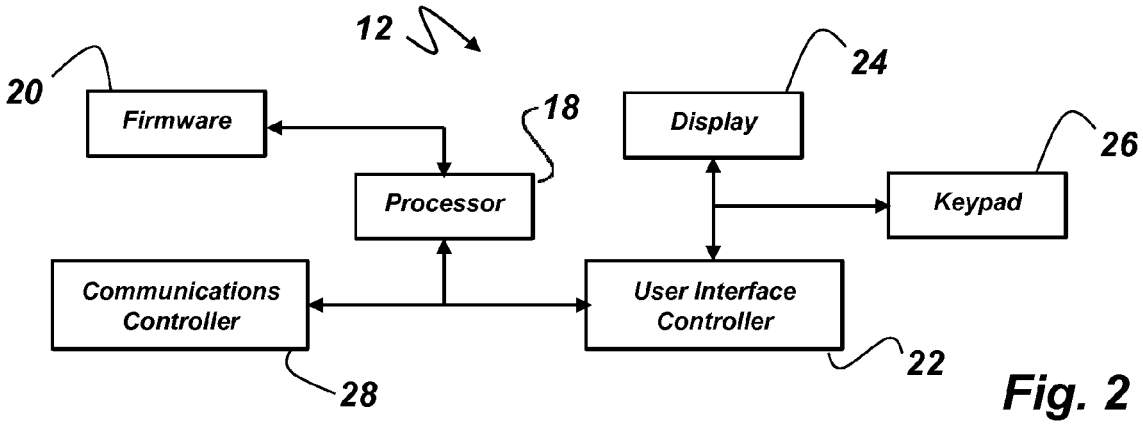
FIG. 2 is a functional block diagram of the handheld device of FIG. 1.

With further reference to FIG. 2, the handheld device 12 includes a microprocessor 18, firmware 20, user interface controller 22, a graphic display 24, a user keypad 26 and a communications controller 28. The display 24 may be a conventional LCD screen providing a graphic user interface with user input data being entered at the user keypad 26 with conventional keys or membranes. Alternatively, the display 24 may also be touch enabled LCD screen such that the user keypad 26 appears as a graphic in the display 24. In either event, the user interface controller 22 in communication with the processor 18 provides the necessary drivers for either type of user interface.

In addition to a conventional operating system, the firmware 20 may include a software application (APP), the code of which when executed implements a process described in further detail herein below. As described herein, the APP is an application registered with the operating system of the handheld device 12. It is to be understood that the APP may also exist as a standalone application, which may also be installed on any type of user device as described in the priority application referenced above. Accordingly, the present invention is not to be limited in scope to a dedicated special purpose user device, such as the handheld device 12, but may be any device which executes application code to implement a process within the scope of the present invention.

The communications controller 28 negotiates known protocols for establishing wireless communications with the network 16, or protocols for direct wireless communication with the tote board 14. Irrespective of the whether the tote board 14 is to be accessed directly through wireless communications or through the network 18, published public and proprietary protocols relating to data formats, credentials and the like are negotiated to provide proprietary data to the handheld device 12 upon bidirectional communications being established therewith. The communications controller 28 when connected to a tote board 14 remains in communication therewith such that any change of data at the tote board 14 is downloaded to the user device 12 without any user intervention.

Figure 3:
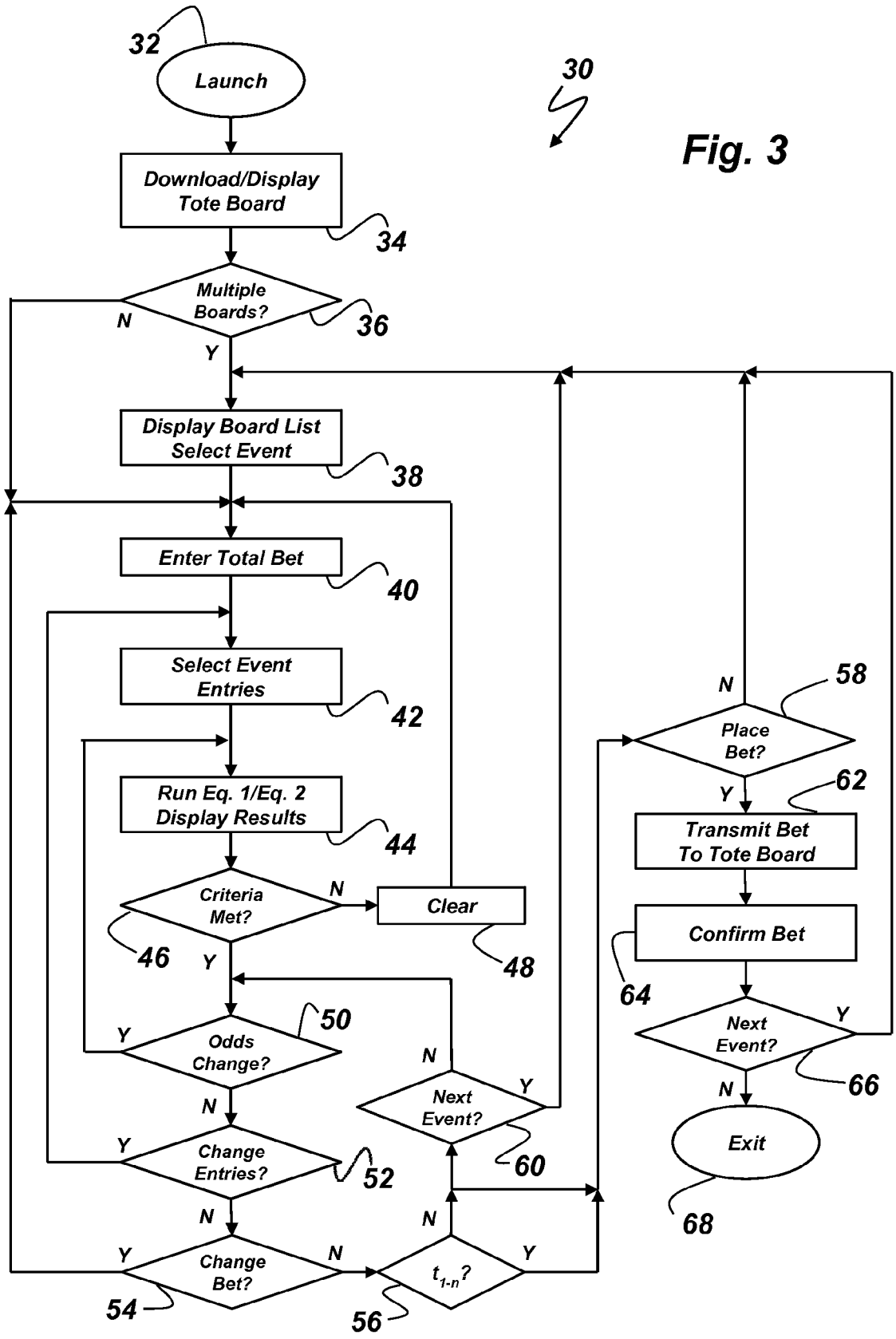
FIG. 3 is a flow chart of an exemplary improved method implemented by code when executed in the handheld device of FIG. 1.

Referring now to FIG. 3, there is shown a flowchart 30 illustrative of an exemplary embodiment of an improved method implemented by the APP when executed in the handheld device 12. Once the APP is installed in the in the handheld device 12, it may be launched, as indicated at 32, by user input conventionally enabled through the above described user interface.

As indicated at 34, upon the APP being launched, the APP initiates the process of negotiating the installed communications protocols through the communications controller 28 to connect with any active tote board 14 which is found locally or in the network 16. Upon any such connection being established, the event data published by each active tote board 14 is downloaded to the handheld device 12. The data published by each active tote board 14 is streamed into the handheld device 12 via a set of standardized requests, called application programming interfaces (API), that have been defined for the APP. The APP and the tote board 14 communicate to each other without any need for user knowledge or intervention as the API of the underlying operating system performs basic functions such as accessing the file system and pertinent data that is entered from the database of the tote board 14 into the handheld device 12. Such data from each tote board 14 includes a listing of one or more events, a listing of each competitive entry in each event, and other data as pertinent to each listing such as odds for each competitive entry. Such data may also include other information as may be typically provided by tote boards.

Once the event data from all of the active tote boards 14 that have been found is downloaded to the handheld device 12, a decision is made, indicated at 36, whether data form one or multiple boards 14 has been downloaded. If the decision is YES, the list of the active tote boards 14 and the event(s) presently available for wagering at each tote board 14 is presented through the user interface. One or more of the tote boards 14 may then be selected through the user interface. Otherwise, if the decision is NO since only one tote board 14 has been found, then the selection of this tote board 14 is made by default.

If more than one tote board 14 is selected, each of the following described steps of this flowchart 30 may be performed as a parallel, but not in lock step, process with respect to each selected tote board 14. For example, the user interface may provided for switching between the displayed information for each active tote board 14, or may present the data for multiple tote boards 14 simultaneously on the display 24.

Figure 4:
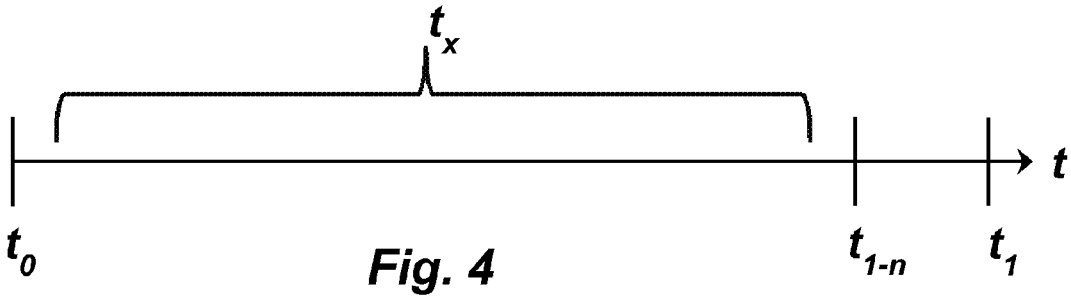
FIG. 4 is a timeline relating to the method of FIG. 3.

With further reference to FIG. 4, the selection of any tote board 14 begins a process which occurs at a time, $t_0$, respective to the selected tote board 14. Once the tote board 14 has been selected, whether through the user interface or by default, a total monetary amount of a wager or bet, which is selected to be put at risk for the active event, is entered through the user interface, as indicated at 40. Next, as indicated at 42, a subset of all the competing entries in the selected event, over which subset the total bet is to be allocated, is selected. Exemplarily, in an event with N total entries, the subset is any number x wherein $1<x\leqq N$.

Upon the total bet, $B_T$, on the event having been entered and the entries for such event having been selected, a portion of the total amount of the bet, $B_x$, to be allocated to or placed on the $x^{th}$ entry in the event is computed, as indicated at 44. This computation is made in accordance with the formula $$B_x = B_T \times \frac{OD_x}{S_{OD}} + \Delta \qquad \text{(Eq. 1)}$$

in which $$B_T = \sum_1^x B_x;$$

and in which $$OD_x = \frac{1}{O_x + 1}$$

wherein $O_x$ is equal to the odds on the $x^{th}$ entry in the contest, and further in which $$S_{OD} = \sum_1^x OD_x.$$

In the algorithm of Eq. 1, the term $\Delta$ is automatically computed such that $B_x$ is rounded to the nearest whole integer. The odds, $O_x$, are the most current odds streamed to the device via the API.

Continuing with the procedures being described at 44, the percent profit, $P_x$, to be realized in the event the $x^{th}$ entry with odds $O_x$ in the contest wins is computed in accordance with the formula $$P_x = \frac{\frac{B_x}{OD_x} - B_T}{B_T} \times 100\%. \quad \text{(Eq. 2)}$$

Upon completion of the computations of Eq. 1 and Eq. 2, the results of the computations are presented on the display 24.

Next, as indicated at 46, each $P_x$ is satisfies a condition such as being compared to a predetermined criterion, which may either be selectively entered through the user interface, embedded in the firmware of the APP, or both. An example of a selectively entered criterion may be a minimum percent profit, $P_x$ to be realized from placing the total amount of the bet, $B_T$, in the currently selected event. In some situations, this predetermined profit, P, may be the same irrespective of which of the $x^{th}$ entry in the contest is the ultimate winner, then effectively $P_x$=P. Using this example the determination may then be made whether the profit $P_x$ compares favorably, e.g., greater than, or unfavorably, e.g., less than, the predetermined profit, P.

Continuing with this example, if the comparison is unfavorable, the NO path is taken, and the bet and entry data inputted through the user interface may be cleared, by default or through intervention at the user interface, as indicated at 48, and the calculation of the portion of the amount to be wagered on each entry halted. If the data is to be cleared through intervention at the user interface, then it may be preferable that no further action be taken in the process until such intervention occurs. In either event, process reiteratively resumes allowing re-entry of either the total bet at 40, or the selection of entries at 42, or both.

Otherwise, if the comparison is favorable in this example, the YES path is taken and a determination is made whether the odds, $O_x$, on any of the selected entries have changed, as indicated 50. In pari-mutuel wagering, the odds are continuously changing in accordance with the bets being placed on each, and these odds are continuously being streamed from the active tote board 14 with which the handheld device 12 is in communication. If the odds have changed since the last computation of Eq. 1 and Eq. 2, the YES path is taken to reiterate the calculation of the Eq. 1 and Eq. 2 at 44 and the decision at 46, as above described.

During this reiteration, the decision taken at 46 may now be unfavorable with respect to the predetermined profit, as described above, resulting in the bet and entry data being cleared at 48, as described above. Moreover, additional criteria may be evaluated at 48, as described in the priority application above referenced.

If there has not been any change of odds since the last computation of Eq. 1 and Eq. 2, the NO path is taken, and several actions may be taken through the user interface of the handheld device 12 as follows. The entries of the selected event may be changed, as indicated at 52, or the total bet may be changed, as indicated at 54. If the user interface detects that a change of entries has been made at 52, process reiterates back to the selection of entries at 42, whereat the odds for the new entries are used for the computation of Eq. 1 and Eq. 2 at 44. Similarly, if the user interface detects that a change of the total bet has been made, process reiterates back to the entry of the total bet at 40, whereat the computation of Eq. 1 and Eq. 2 at 44 is reiterated with or without any further change in the entries.

All of the above described processes, decisions and reiterations as such may occur between the initial entry of the total bet at 40 and the user interface not detecting any change of entries at 52 or change of bet at 54, occurs within a continuous timeline indicated by $t_x$ in FIG. 4. Furthermore, the APP is continuously monitoring for any transmission through the API for the active tote board 14 for which the current process is running, to determine if a cutoff time or a countdown to such cutoff time, $t_{1-n}$, after which wagering is closed prior to the start of the event at time, $t_1$, has been sent to the handheld device 12, as indicated at 56. As long as the decision at 56 remains negative, at any time during the time $t_x$ in which there has not been any change of odds, entries or total bets resulting in reiterations of the forgoing process, the APP may detect that a decision to place the current bet on the current entries has been positively made through the user interface, as indicated at 58.

Alternatively, as the decision at 56 remains negative, the user of the handheld device 12 may, as indicated by the NO path at 60, allow the current process for the active tote board 14 to reiterate monitoring for changes at the odds data at 50, or user interface changes to the entries at 52 or the bet at 54. Otherwise, the user may, as indicated by the YES path at 60, desire to run the process on a different selected event at another active tote board 14. In the latter case, the process for each tote board 14 runs simultaneously with the user interface allowing switching between them.

If the App detects a positive decision at 58 to place the current bet on the selected entries, the APP through the API and communications controller 28 transmits the bet and entry data to the active tote board 14, as indicated at 62. The active tote board may respond, as indicated at 64, with confirmation that the data has been received, accepted and the bets on each entry entered.

After such confirmation has been received, the user interface may detect, as indicated at 66, that as selection to another event for the same or another tote board being made through the user interface, thus taking the YES path to begin a new process at 38. Otherwise, the NO path may be taken and the APP exited, as indicated at 68, at user discretion.

Returning to the decision at 56, if the time, $t_{1-n}$, is positively indicated as a notice of an imminent cutoff time, the process flow warns through the user interface that the current bets on the selected entries must be placed pausing the process and waiting for an indication through the user interface of the decision to be made at 58. If the bet is to be place, the bet is placed as described above at 62. Otherwise, if the bet is not to be placed, the process may return to a selection to be made at 38 of other events at the same or other tote boards.

There has been described hereinabove novel apparatus and method for pari-mutuel wagering. Those skilled in the art may now make numerous uses of, and departures from, the hereinabove described embodiments without departing from the inventive principles disclosed herein. Accordingly, the present invention is to be defined solely by the lawfully permissible scope of the appended Claims.

What is claimed as the invention is:

1. A wager allocation apparatus for allocating wagers to be placed on a subset of entries in a competitive pari-mutuel wagering event in which event data is electronically published for further electronic transmission wherein the event data includes at least a listing of the entries and the odds for each respective one of the entries and further wherein the published odds for any one of the entries is subject to being changed prior to commencement of the event, the apparatus comprising:

a communications controller operative to receive continuously the electronically published and transmitted event data;

a user interface operative to receive user input data wherein the user data includes at least a selection of at least two of the entries in the wagering event and a total monetary amount to be wagered in the wagering event and further operative to display the event data and the user data visually; and a processor module responsive to receipt of the user input data and the continuously received event data and operative to calculate reiteratively a portion of the total monetary amount to be wagered on each selected entry in accordance with the formula $$B_x = B_T \times \frac{OD_x}{S_{OD}} + \Delta$$

wherein $B_x$ is the amount to be placed on the $x^{th}$ one of the entries in the event, $B_T$, is the total monetary amount such that $$B_T = \sum_1^x B_x,$$

wherein $$OD_x = \frac{1}{O_x + 1}$$

in which $O_x$ is equal to the current published odds on the $x^{th}$ one of the entries in the event, and further wherein $$S_{OD} = \sum_1^x OD_x.$$

the user interface being further operative to display the portion of the total monetary amount to be wagered respectively on each one of the selected entries upon each such portion being reiteratively calculated;

wherein the processor module during a time duration prior to commencement of the wagering event in which a condition of a predetermined criterion is satisfied is further responsive to input at the user interface indicating that the current portion of the total monetary amount to be wagered on each selected entry is to be sent to the wagering event as a wager to be placed on each selected entry and in response thereto operative to send through the communications controller electronic data representing the wager to be placed on each selected entry in the wagering event.

2. An apparatus as set forth in claim 1 wherein the processor module is further operative to halt further calculation of the portion of the total monetary amount to be wagered in response to a condition of the predetermined criterion not being satisfied.

3. An apparatus as set forth in claim 1 wherein the processor module in response to a receipt of notification of a cutoff time from the tote board is operative to require a decision to be made at the user interface to transmit the portion of the total monetary amount to be wagered for each entry to be transmitted to the tote board.

4. An apparatus as set forth in claim 1 wherein the processor module in response to a receipt from the tote board of confirmation of the wager on each entry being placed is operative to display such confirmation at the user interface.

5. An apparatus as set forth in claim 1 wherein the predetermined criterion is percent profit, $P_x$, to be realized in the event the $x^{th}$ entry with odds $O_x$ in the event wins computed in accordance with the formula $$P_x = \frac{\frac{B_x}{OD_x} - B_T}{B_T} \times 100\%.$$

6. An apparatus as set forth in claim 2 wherein the processor module is further operative to clear automatically the user input data in response to the condition not being satisfied.

7. An apparatus as set forth in claim 6 wherein the processor module is further operative to resume reiterative calculation of the portion of the total monetary amount to be wagered on each entry in response to re-entry of the user input data.

8. An apparatus as set forth in claim 2 wherein the processor module is further operative to resume reiterative calculation of the portion of the total monetary amount to be wagered on each entry in response to selective clearing through intervention at the user interface of the user input data and re-entry of the user input data.

9. A wager allocation method for allocating wagers to be placed on a subset of entries in a competitive pari-mutuel wagering event in which event data is electronically published for further electronic transmission wherein the event data includes at least a listing of the entries and the odds for each respective one of the entries and further wherein the published odds for any one of the entries is subject to being changed prior to commencement of the event, the method comprising the steps of:

receiving continuously the electronically published and transmitted event data and displaying the event data in a user interface;

receiving user input data entered at the user interface wherein the user data includes at least a selection of at least two of the entries in the wagering event and a total monetary amount to be wagered in the event;

calculating reiteratively in response to receipt of the user input data and the continuously received event data a portion of the total monetary amount to be wagered on each selected entry in accordance with the formula $$B_x = B_T \times \frac{OD_x}{S_{OD}} + \Delta$$

wherein $B_x$ is the amount to be placed on the $x^{th}$ one of the entries in the event, $B_T$, is the total monetary amount such that $$B_T = \sum_1^x B_x,$$

wherein $$OD_x = \frac{1}{O_x + 1}$$

in which $O_x$ is equal to the current published odds on the $x^{th}$ one of the entries in the event, and further wherein $$S_{OD} = \sum_{1}^{x} OD_x.$$

and displaying in the user interface the portion of the total monetary amount to be wagered respectively on each entry upon each such portion being reiteratively calculated; and selectively transmitting in response to input at the user interface, wherein the input is enabled prior to commencement of the wagering event during a time duration in which a condition of a predetermined criterion is satisfied, electronic data to the wagering event wherein the electronic data represents the portion of the total monetary amount to be wagered on each entry as a wager to be placed on each selected entry in the wagering event.

10. A method as set forth in claim 9 further comprising the steps of halting further calculation of the portion of the total monetary amount to be wagered in response to a condition of the predetermined criterion not being satisfied.

11. A method as set forth in claim 9 further comprising the steps of requiring a decision to be made at the user interface to transmit the portion of the total monetary amount to be wagered for each entry to be transmitted to the tote board in response to a receipt of notification of a cutoff time from the tote board.

12. A method as set forth in claim 9 further comprising the steps of displaying confirmation at the user interface of receipt from the tote board of confirmation of the wager on each entry being placed.

13. A method as set forth in claim 9 wherein the predetermined criterion is percent profit, $P_x$, to be realized in the event the $x^{th}$ entry with odds $O_x$ in the event wins computed in accordance with the formula $$P_x = \frac{\frac{B_x}{OD_x} - B_T}{B_T} \times 100\%.$$

14. A method as set forth in claim 10 further comprising the steps of clearing automatically the user input data in response to the condition not being satisfied.

15. A method as set forth in claim 14 wherein the calculating step is resumed in response to re-entry of the user input data.

16. A method as set forth in claim 10 further comprising the steps of selectively clearing through intervention at the user interface the user input data, the calculating step being resumed in response to the receiving step being re-performed subsequently to the selectively clearing step.

* * * * *